US006942465B2

(12) United States Patent
Kawachi et al.

(10) Patent No.: US 6,942,465 B2
(45) Date of Patent: Sep. 13, 2005

(54) COMPRESSOR

(75) Inventors: Masaki Kawachi, Tochigi (JP); Masanori Ogawa, Tochigi (JP); Hiroyuki Makishima, Tochigi (JP); Hiroshi Kageyama, Tochigi (JP); Susumu Higano, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 209 days.

(21) Appl. No.: 10/391,207

(22) Filed: Mar. 19, 2003

(65) Prior Publication Data

US 2004/0005223 A1 Jan. 8, 2004

(30) Foreign Application Priority Data

Mar. 20, 2002 (JP) ..... 2002-078730
Mar. 3, 2003 (JP) ..... 2003-056101

(51) Int. Cl.[7] ..... F04B 1/12
(52) U.S. Cl. ..... 417/269; 92/71; 184/6.17
(58) Field of Search ..... 417/222.1, 222.2, 417/269; 92/71, 154; 184/6.17

(56) References Cited

U.S. PATENT DOCUMENTS 4,729,719 A * 3/1988 Kayukawa et al. ..... 417/222.2
5,181,834 A * 1/1993 Ikeda et al. ..... 417/269
5,286,172 A * 2/1994 Taguchi ..... 417/222.2
5,332,365 A * 7/1994 Taguchi ..... 417/222.2
6,786,703 B2 * 9/2004 Breindel et al. ..... 417/222.2

FOREIGN PATENT DOCUMENTS

JP 5-231309 A 9/1993
JP 6-123280 A 5/1994

* cited by examiner

*Primary Examiner*—Charles G Freay
(74) *Attorney, Agent, or Firm*—Foley & Lardner LLP

(57) ABSTRACT

A compressor is disclosed having a gas extraction passage, internally formed in a drive shaft and continuously communicating with a crank chamber and a suction chamber, that has an inlet portion, to be exposed to the crank chamber, is formed in the drive shaft in a radial direction. As a result, mist-like oil accompanied by blow-by gas tending to flow into the gas extraction passage initially impinges upon and adheres to an inner peripheral surface of the inlet portion of the gas extraction passage due to rotational movement of the drive shaft. Namely, oil separation (gas-liquid separation) occurs at the inlet portion of the gas extraction passage. Then, oil separated from the blow-by gas at the inlet portion of the gas extraction passage is forcibly returned to the crank chamber due to a centrifugal force caused by rotational movement of the drive shaft. Accordingly, the compressor has a structure in which oil accompanied by blow-by gas is hard to escape the suction chamber.

13 Claims, 15 Drawing Sheets

FIG. 4

AMOUNT OF RESIDUAL OIL IN CRANK CHAMBER
(COMPARED TO RELATED ART)

| | | SHAFT-ROTATIONAL SPEED | | |
|---|---|---|---|---|
| | | 700rpm | 1800rpm | 7000rpm |
| ATMOSPHERIC TEMP | LOW TEMP | 120% | 150% | 120% |
| | HIGH TEMP | 175% | 200% | 200% |

COMPRESSOR

CROSS REFERENCE TO RELATED APPLICATION

This application claims benefit of priority under 35 U.S.C. §119 to Japanese Patent Application No. 2002-078730, filed on Mar. 20, 2002, and No. 2003-56101, filed on Mar. 3, 2003, the entire contents of which are incorporated by reference herein.

BACKGROUND OF THE INVENTION

1. Field of the Invention

The present invention relates to a compressor adapted to be disposed in a refrigeration cycle, such as a vehicle air conditioning apparatus, for use in compression of refrigerant gas.

2. Description of the Related Art

In general, a compressor has a crank chamber in which lubricating oil is normally stored for the purpose of supplying lubricating oil to various sliding component parts disposed in the crank chamber. However, as disclosed in Japanese Patent Provisional Publication No. 62-203980, since the compressor of this type has an gas extraction passage that communicates with the crank chamber and a suction chamber, an issue arises in that lubricating oil flows from the crank chamber to the suction chamber through the gas extraction passage.

If lubricating oil is carried from the crank chamber, the following two principal issues arise. First, if lubricating oil is carried from the crank chamber to result in shortage in oil to be supplied to the sliding component parts in the crank chamber, an adverse affect is caused in the sliding component parts. Second, if lubricating oil flows from the crank chamber into a heat exchanger (especially a condenser or an evaporator in the heat exchanger) in a refrigeration cycle through a path including the crank chamber→the suction chamber→the cylinder bore→the discharge chamber→the compressor exterior→the heat exchanger, lubricating oil adheres to capillary tubes of the heat exchanger, resulting in deterioration in a heat exchange efficiency.

In view of the above in mind, as disclosed in Japanese Patent Provisional Publication No. 58-158382, there is also a related art compressor with a structure wherein an outlet of an gas extraction passage is connected to a control valve that is expected to have the same function as an orifice. However, with the control valve of this related art technology, an opening and closing valve of the gas extraction passage is closed during an inoperative state of the compressor and, during operative state of the compressor, the opening and closing valve of the gas extraction passage is opened. As a result, even though oil is separated from gas, oil accompanied by gas flow is gradually flown out from a crank chamber too. Also, the presence of the control valve causes the gas extraction passage to be complicated in structure.

SUMMARY OF THE INVENTION

It is therefore an object of the present invention to provide a compressor that is able to decrease an amount of oil flow escaping from a crank chamber through a gas extraction passage in a simplified structure.

To achieve the above object, according to an aspect of the present invention, there is provided A compressor comprising: a cylinder block having a cylinder bore for accommodating a piston, bearings for supporting an end portion of a drive shaft, and a shaft support bore disposed between the bearings and a rear end of the cylinder block; a front housing attached to a front end of the cylinder block and formed with a crank chamber in which the piston is reciprocally moveable due to rotation of the drive shaft; and a rear housing attached to the rear end of the cylinder block via a valve plate and formed with a suction chamber and a discharge chamber therein, wherein a distal end portion of the drive shaft having a first gas extraction aperture is rotatably fitted in the shaft support bore attached to the valve plate having a second gas extraction aperture at rear end of the cylinder block, in the first gas extraction aperture, one opening end thereof being directly open to the crank chamber and the other opening end thereof being open to the shaft support bore, in the second gas extraction aperture, one opening end thereof being open to the shaft support bore and the other opening end thereof being open to the suction chamber.

According to the present invention, the compressor features the provision of the gas extraction passage, establishing continuous communication between the crank chamber and the suction chamber, that has the inlet portion being directly open to the crank chamber in the drive shaft. With this structure, mist-like oil, accompanied by blow-by gas, tending to flow into the gas extraction passage initially impinges upon and is captured by an inner peripheral surface of the inlet portion of the gas extraction passage due to rotational movement of the drive shaft. That is, oil separation (gas-liquid separation) occurs at the inlet portion of the gas extraction passage. Then, oil separated from refrigeration gas at the inlet portion of the gas extraction passage is forced back to the crank chamber due to a centrifugal force caused by rotational movement of the drive shaft. Consequently, the compressor of the present invention has a structure in which oil is hard to escape into the suction chamber through the gas extraction passage. Since this results in a structure in that, even though the crank chamber continuously communicates with the suction chamber through the gas extraction passage without intervening the control valve, oil separation (gas-oil separation) positively occurs, it is possible to reduce an amount of oil, to be flown out from the crank chamber through the gas extraction passage, in a simplified structure.

BRIEF DESCRIPTION OF THE DRAWINGS

FIG. 4 is a comparison view showing a flow restriction effect, for lubricating oil of the compressor shown in FIG. 1, in comparison with that of the related art structure.

DETAILED DESCRIPTION OF THE PREFERRED EMBODIMENTS

Hereinafter, embodiments of the present invention are described with reference to the drawings.

(First Embodiment)

Figure 1:
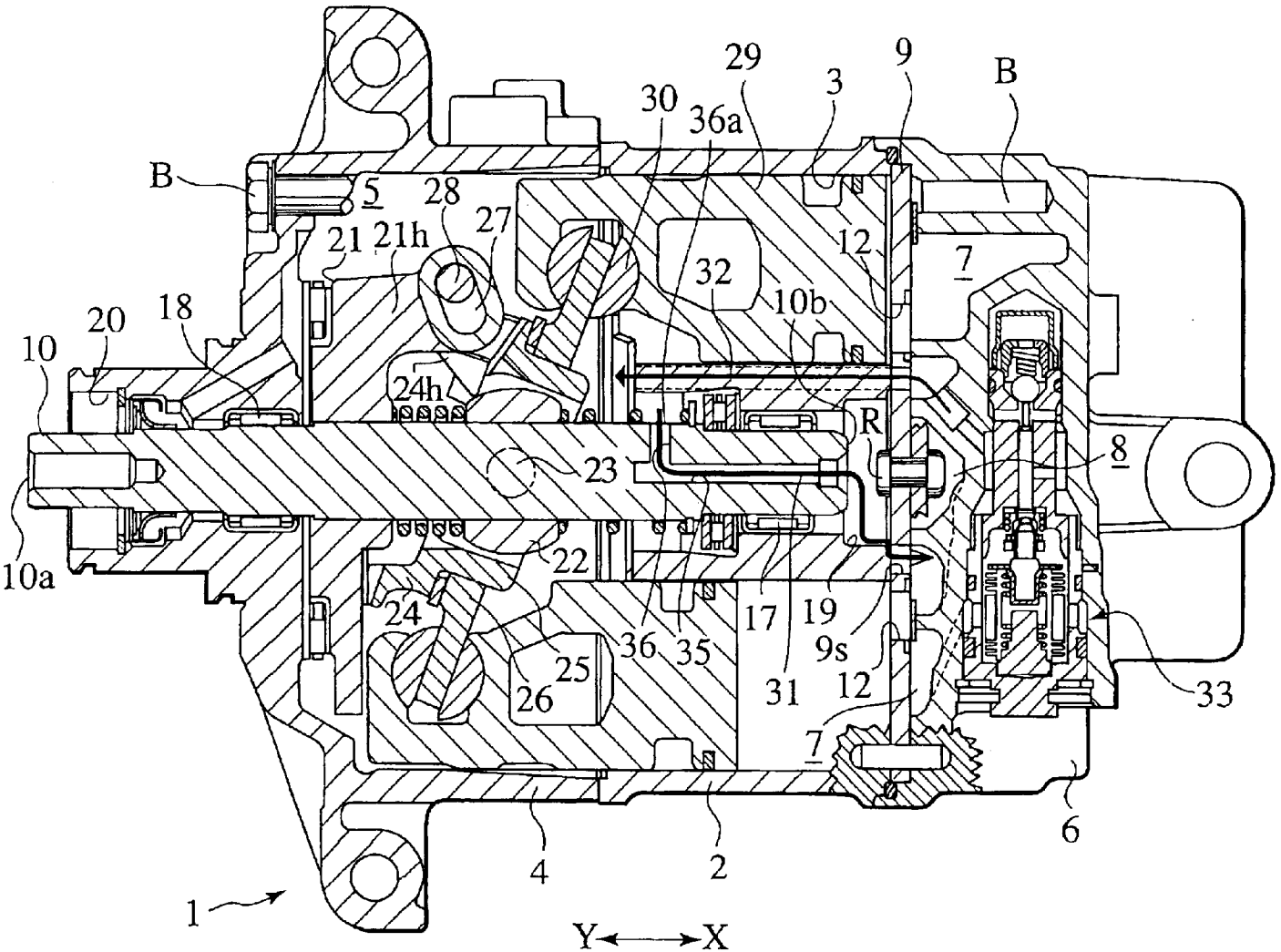
FIG. 1 is an overall view of a compressor in the first embodiment according to the present invention.

As shown in FIG. 1, a compressor 1 is of a swash plate type variable displacement compressor. The swash plate type variable displacement compressor 1 is comprised of a cylinder block 2 having a plurality of cylinder bores 3, a front housing 4 attached to a front end of the cylinder block 2 and cooperating with the cylinder block 2 to define an air tight sealed crank chamber 5, and a rear housing 6 attached to a rear end of the cylinder block 2 via a valve plate 9 and including a suction chamber 7 and a discharge chamber 8. Further, the cylinder block 2, the front housing 4 and the rear housing 6 are fixedly connected to one another by means of a plurality of penetrating bolts B extending through a plurality of bolt-through-bores (not shown) formed in the cylinder block 2.

The valve plate 9 is formed with a suction port (not shown) that communicates with the cylinder bore 3 and the suction chamber 7, and a discharge port 12 that communicates with the cylinder bore 3 and the discharge chamber 8.

Figure 3:
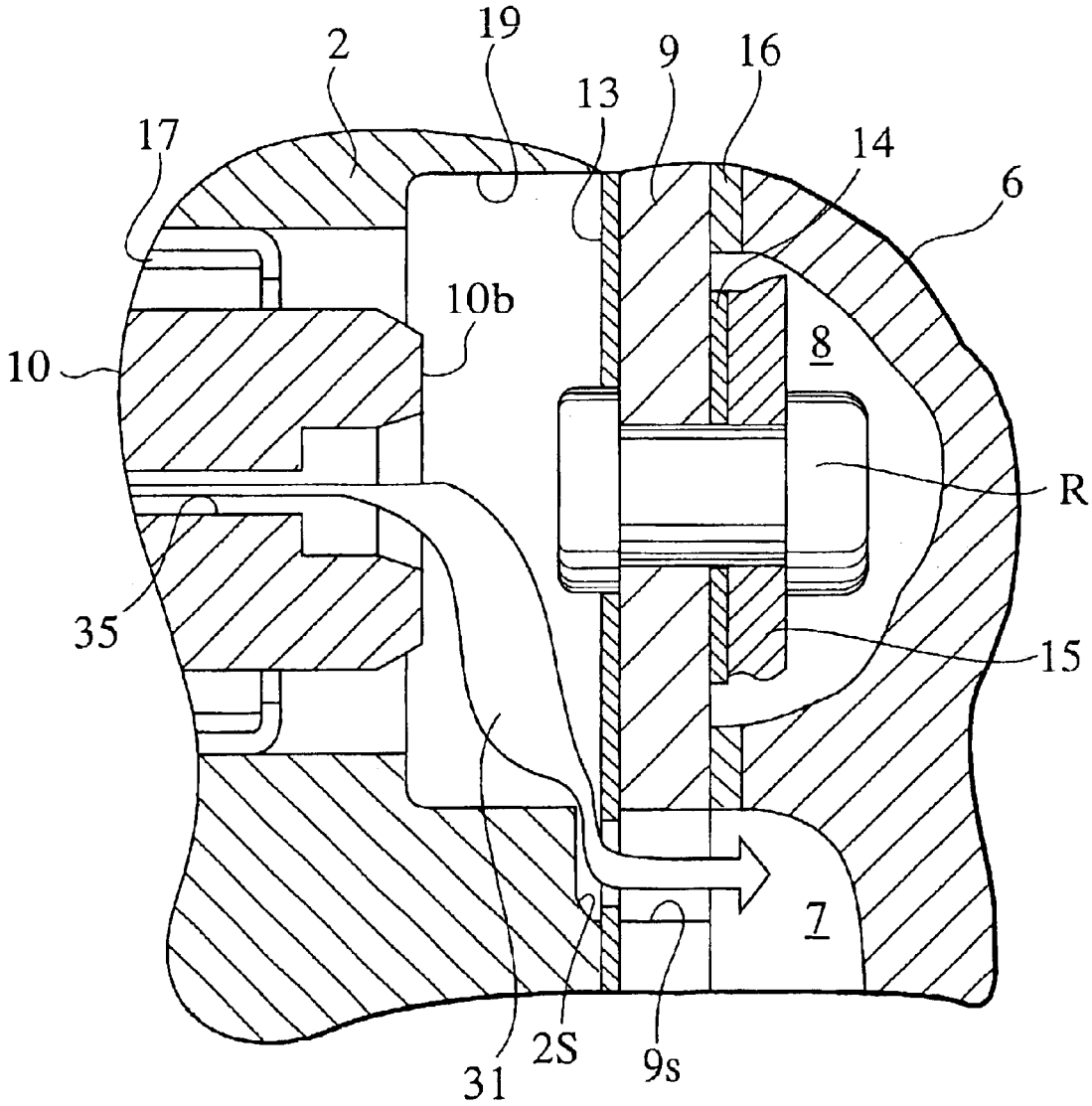
FIG. 3 is an enlarged cross sectional view illustrating an outlet side of the gas extraction passage of the compressor shown in FIG. 1.

As shown in FIG. 3, a suction valve plate 13, made from a metallic sheet, is attached to the valve plate 9 at one surface thereof closer to the cylinder block 2 and has a lead valve (not shown) adapted to open or close the suction port. On the other hand, disposed on the valve plate 9 at the other surface thereof closer to the rear housing 6 are a discharge valve plate 14, made from a metallic sheet, that has a lead valve (not shown) adapted to open or close the discharge port 12, and a retainer 15 that retains the discharge valve plate 14 in a fixed place and restricts an opening degree of the lead valve of the discharge valve plate 14. The valve plate 9, the discharge valve plate 14 and the retainer 15 are fixedly secured in a unitary structure. Also, a gasket 16 is interposed between the valve plate 9, at an other area than those where the above-described components are disposed, and the rear housing 6 for providing an airtight sealing property between the suction chamber 7 and the discharge chamber 8. Moreover, an O-ring is disposed at an outer circumferential periphery of the valve plate 9 to preclude refrigerant from leaking to the outside of the compressor 1.

As shown in FIG. 1, centrally formed in the cylinder block 2 and the front housing 4 are shaft support bores 19, 20 fitted with bearings 17, 18, 37 by which a drive shaft 10 is rotatably supported. Especially, the bearing 17, 37 rotatably supports a rear end portion of the drive shaft 10.

Disposed within the crank chamber 5 are a drive plate 21 fixedly mounted on the drive shaft 10 adjacent one of the crank chamber 5, a journal 24 connected through a pin 23 to a sleeve 22, for rocking movements, that is slidably disposed on the drive shaft 10, and a swash plate 26 that is fixed to a boss segment 25 of the journal 24.

The drive plate 21 and the journal 24 have hinge arms 21*h*, 24*h*, respectively, that are connected to one another by means of an elongated slot 27 and a pin 28, thereby restricting rocking movements of the swash plate 26. Slidably disposed in each of the cylinder bores 3 is a piston 29 that is connected to the swash plate 26 through a pair of shoes 30 by which the swash plate 26 is sandwiched, resulting in reciprocating movements of the piston 29 based on motive power caused by rotational movement of the drive shaft 10. Thus, the compressor 1 has a basic function in that reciprocating movements of the piston 29 sucks refrigerant in a path through the suction chamber 7→the suction port of the valve plate 9→the cylinder bore 3 and compresses sucked refrigerant whereupon compressed refrigerant is discharged in a path through the cylinder bore 3→the discharge port of the valve plate 9→the discharge chamber 8.

Further, in order to permit the piston 29 to have a variable discharge volume, the compressor 1 includes a pressure control mechanism which is comprised of a gas extraction passage 31 (as shown by an arrow in FIG. 1) that allows the crank chamber 5 to continuously communicate with the suction chamber 7, an air supply passage 32 through which the crank chamber 5 communicates with the discharge chamber 8 (as shown by another arrow in FIG. 1), and a pressure control means 33 that opens or closes the air supply passage 32. The gas extraction passage 31 serves to compel refrigerant gas in the crank chamber 5 to be fed back to the suction chamber 7 in dependence on refrigerant gas pressure within the crank chamber 5. The air supply passage 32 is opened or closed by the pressure control means 33 for thereby controlling a volume of refrigerant gas flowing from the discharge chamber 8 to the crank chamber 5 to regulate pressure within the crank chamber 5 such that an inclination angle of the swash plate 26 changes to vary a length of piston stroke to vary the discharge volume of the compressor 1. More particularly, in order for an evaporator to be avoided from freezing during a low load, the pressure control means 33 is operative to vary the discharge volume of the compressor 1 in dependence on a suction pressure of refrigerant fed back from the compressor 1 such that the air supply passage 32 is controllably opened or closed in a way to maintain a suction pressure of refrigerant to be fed back to the compressor 1 at a given level.

Now, the gas extraction passage 31 is comprised of a gas extraction aperture 10*s* formed in the drive shaft 10, the shaft support bore 19 formed in the cylinder block 2, a gas extraction recess 2*s* formed in a rear distal end of the cylinder block 2, and a gas extraction aperture 9*s* formed in the valve plate 9. In the gas extraction aperture 10*s*, one opening end thereof is directly open to the crank chamber 5 and the other opening end thereof is open to the shaft support bore 19. In the gas extraction recess 2*s*, one opening end thereof is open to the shaft support bore 19 and the other opening end thereof is open to the gas extraction aperture 9*s*. In the gas extraction aperture 9*s*, one opening end thereof is open to the gas extraction recess 2*s* and the other opening end thereof is open to the suction chamber 7. Therefore, the crank chamber 5 continuously communicates with the suction chamber 7 through the gas extraction passage 31 (see FIG. 1 and FIG. 3). Also, the gas extraction recess 2*s* forms a fixed restricting portion (orifice) that restricts an effective cross sectional area of the gas extraction passage 31 at a midway of the gas extraction passage 31.

Figure 2A:
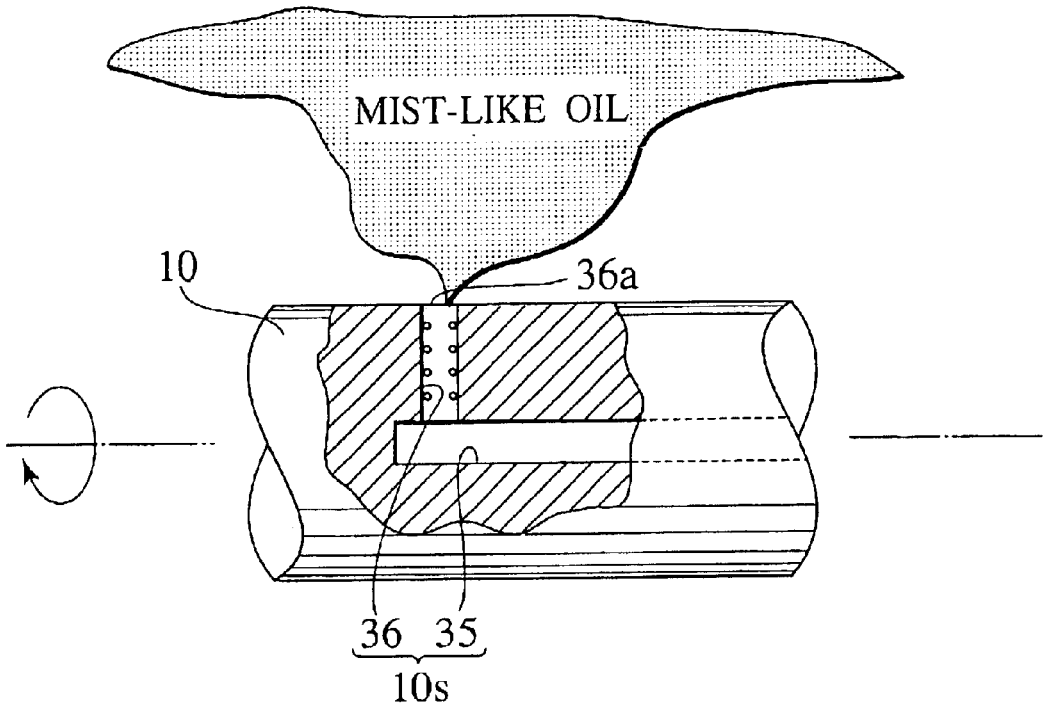
FIGS. 2A and 2B are enlarged views illustrating an inlet side of a gas extraction passage of the compressor shown in FIG. 1.

Further, as shown in FIG. 2A, the gas extraction aperture 10*s* formed in the drive shaft 10 is formed by an axial passage 35 formed in the drive shaft 10 along a central axis thereof so as to extend straight from a rear distal end 10*b* to a front distal end 10*a*, and a radial passage 36 connected to the axial passage 35 in a perpendicular direction thereto and directly opening to the crank chamber 5 to form an inlet portion of the gas extraction passage 31. Also, since the radial passage 36, that forms the inlet portion of the gas extraction passage 31, is formed in the drive shaft 10 at an area displaced from a moveable range of the sleeve 22, the radial passage 36 is continuously open to the crank chamber 5.

Figure 2B:
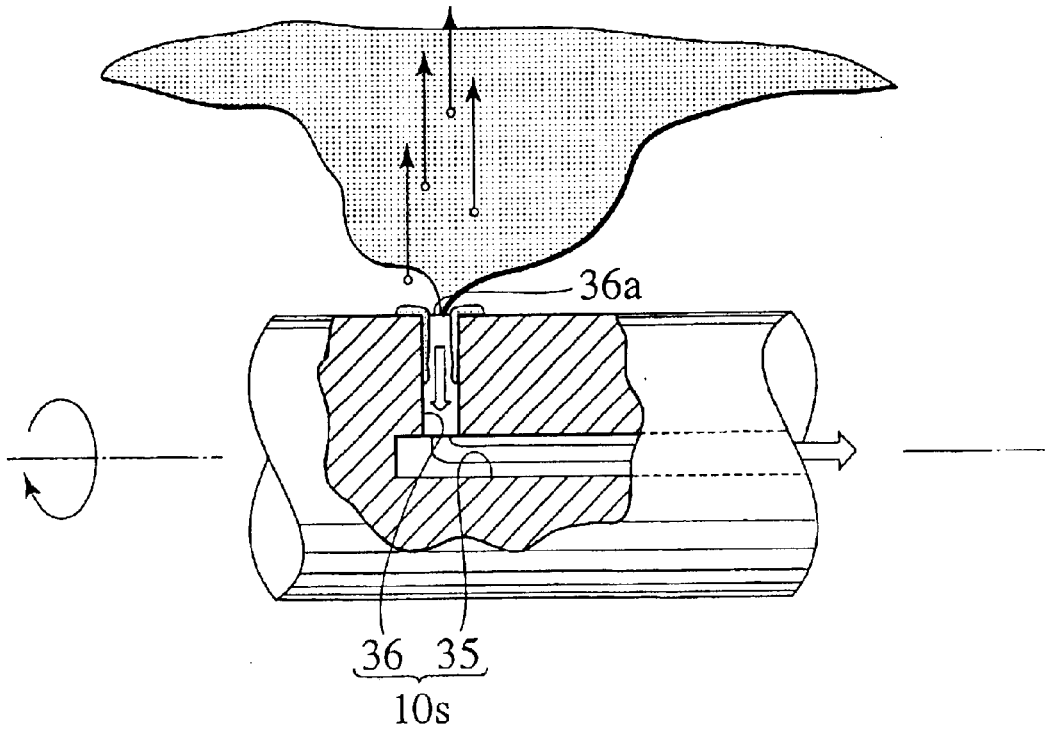

With the compressor 1 of the presently filed embodiment thus constructed, the gas extraction passage 31 is formed in the drive shaft 10 to allow the crank chamber 5 and the suction chamber 7 to continuously communicate with one another, and the radial passage 36 forming the inlet portion of the gas extraction passage 31 is directly exposed to the crank chamber 5. As a result, as shown in FIG. 2A, mist-like oil accompanied by refrigerant gas flowing out from the crank chamber 5 into the gas extraction passage 31 is caused to impinge upon an inner periphery of the radial passage 36 and captured thereto due to rotational movement of the drive shaft 10. That is, within the radial passage 36 forming the inlet portion of the gas extraction passage 31, separation of oil (gas-liquid separation) occurs. Subsequently, as shown in FIG. 2B, oil adhered to the radial passage 36 is forced back to an inlet terminal end 36*a* of the radial passage 36 by a centrifugal force caused by rotational movement of the drive shaft 10 and discharged into the crank chamber 5 remaining separate from refrigerant gas.

As a result of oil being separated and forced back to the crank chamber 5, a structure is provided in which oil is hard to escape to the suction chamber 7 through the gas extraction passage 31, resulting in reduction in a flow rate of oil escaping outward through the oil gas extraction passage 31. Also, the presence of oil scattering toward the crank chamber 5 from the inlet terminal end 36*a* of the radial passage 36 enables oil to be automatically supplied to sliding component parts disposed in the crank chamber 5.

In this connection, Japanese Patent Provisional Publication No. 58-158382 discloses a compressor provided with a gas extraction bore formed in a drive shaft to include an axial passage and a radial passage. Even in this compressor, a centrifugal separating action is expected to occur due to the axial passage.

However, this compressor has a structure in that the radial passage is closed by a sleeve in the first place while a gap between the sleeve and the drive shaft is formed with an inlet portion as a part of the gas extraction bore whereupon oil is supplied to a space between the sleeve and the drive shaft in a path along a stream of gas flow. As a result, oil, that has entered the space between the sleeve and the drive shaft once, is hard to be discharged from that space and adversely affected with gas flow to be finally delivered to a suction chamber.

On the contrary, with the presently filed embodiment, since the radial passage 36 forming the inlet portion of the gas extraction passage 31 is directly open to the crank chamber 5, oil is forced back to the inlet terminal end 36*a* of the radial passage 36 due to the centrifugal force of the drive shaft 10 in a manner set forth above and directly discharged into the crank chamber 5. Accordingly, the centrifugal separating action can be utilized with no waste, thereby enabling reduction in the amount of oil escaping from the crank chamber 5 through the gas extraction passage 31 in a simplified structure. Also, the presence of oil scattering toward the crank chamber 5 from the inlet terminal end 36*a* of the radial passage 36 enables oil to be automatically supplied to the sliding component parts disposed within the crank chamber 5.

With the presently filed embodiment, further, since the radial passage 36, forming the inlet portion of the gas extraction passage 31, is formed in the drive shaft 10 at the area displaced from the moveable range of the sleeve 22 effectuated depending on the discharge volume to be altered, it is not possible that the radial passage 36 is closed by the sleeve 22.

In actual practice, a lubricating oil flow-out restriction effect was conducted after the compressor of the presently filed embodiment had been operated for 0.5 hours, with test results being shown in FIG. 4 that shows the compressor 1 of the presently filed embodiment has larger increased amounts of residual oil remaining in the crank chamber 5 than those of the related art compressor. Here, observing differences among the amounts of remaining oil in terms of the rotational speed, it becomes clear that the larger the rotational speed, the higher will be the oil flow-out restricting effect. This is due to the fact that as the rotational speed of the drive shaft 10 increases, the centrifugal separating action acting on the radial passage 36 increases. Moreover, observing a difference in the amounts of remaining oil in terms of the atmospheric temperature, it appears that the higher the atmospheric temperature, the higher will be the oil flow-out restricting effect. This is due to the fact that as the atmospheric temperature increases, a thermal load increases to cause the compressor to operate under an increased discharge volume with a resultant increase in blow-by gas for thereby increasing the amount of refrigerant gas to be fed back from the crank chamber 5 to the suction chamber 7 through the gas extraction passage 31.

Figure 5:
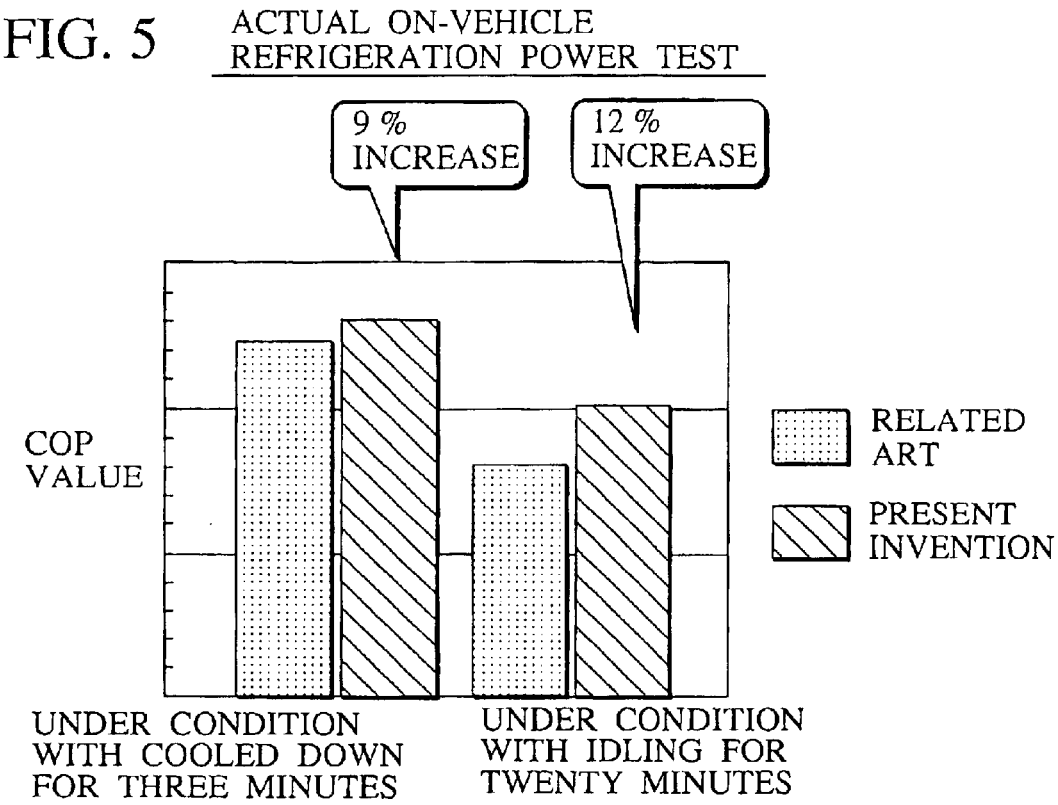
FIG. 5 is a view illustrating a cooling performance of the compressor shown in FIG. 1 in comparison with the related art structure in terms of a COP value.
Figure 6:
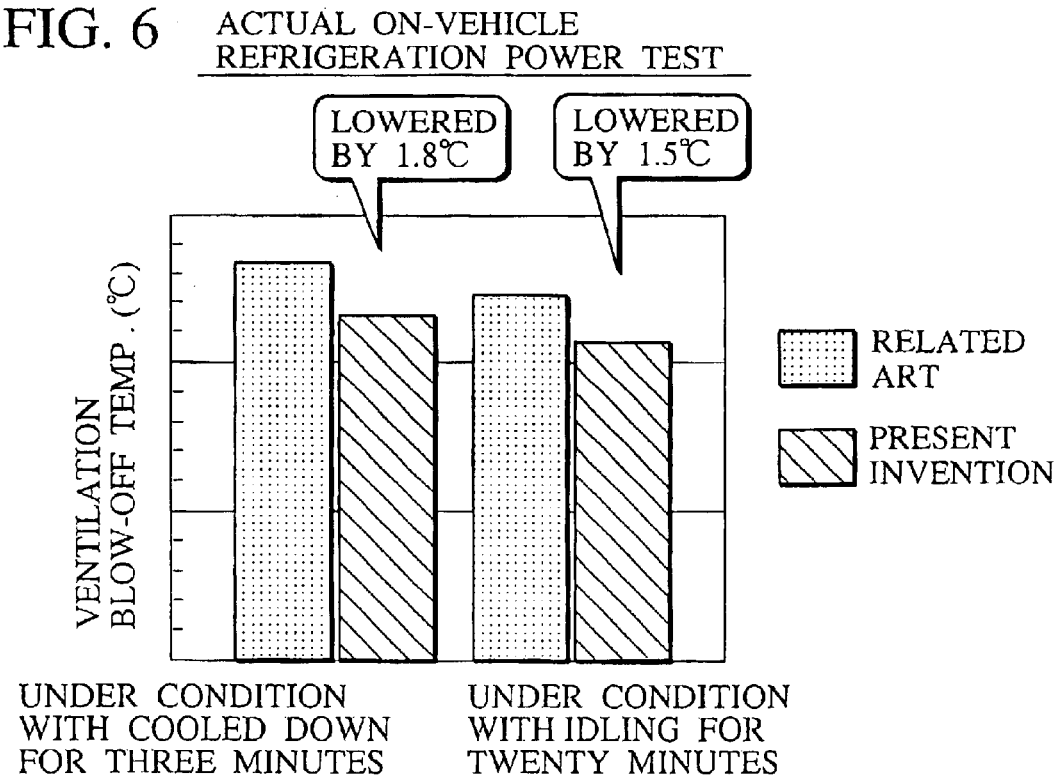
FIG. 6 is a view illustrating the cooling performance of the compressor shown in FIG. 1 in comparison with the related art structure in terms of a ventilation blow-off temperature.

Further, upon conducting an actual on-vehicle refrigeration power test for a refrigeration cycle using the compressor 1 with the oil flow-out restricting effect set forth above, as shown in FIG. 5, a COP value (=a cooling performance [W]/power [W]) of the present embodiment had a 9% increase in improvement higher than that of the prior art in terms of a cooled down condition for three minutes and a 12% increase in improvement higher than that of the prior art in terms of an idling condition for twenty minutes. Likewise, as shown in FIG. 6, the present embodiment achieved a lower ventilation blow-off temperature, appearing under the conditions set forth above, lower than the prior art by 1.8 degree C. in terms of the cooled down condition for three minutes and the lower ventilation blow-off temperature lower than the prior art by 1.5 degree C. in terms of the idling condition for twenty minutes. Also, the actual refrigeration power test means the cooling capacity test of the refrigerating cycle, based on a rule defined by the present company to which the applicant belongs, with the cooling power test being conducted under a condition in which an actual vehicle is driven at a speed of 40 [km/h] for thirty minutes and subsequently driven at a speed of 100 [km/h] under the cooled down condition for twenty minutes whereupon the vehicle is driven under the idling condition for twenty minutes.

Thus, in the refrigeration cycle using the compressor 1 of the presently filed embodiment, due to reduction in the amount of oil to be flown out from the compressor 1 in a manner described above, it is possible to reduce the amount of oil to enter a heat exchanger (involving a condenser or an evaporator therein) in the refrigeration cycle. That is, the presence of reduction in the amount of oil that adheres to capillary tubes of he heat exchanger provides an improvement over the cooling performance of the refrigeration cycle. Also, the test results of the related art shown in FIGS. 4 to 6 corresponds to those of the compressor that utilizes the through-bore of the cylinder block 2 as a gas extraction passage.

(Second Embodiment)

Figure 12:
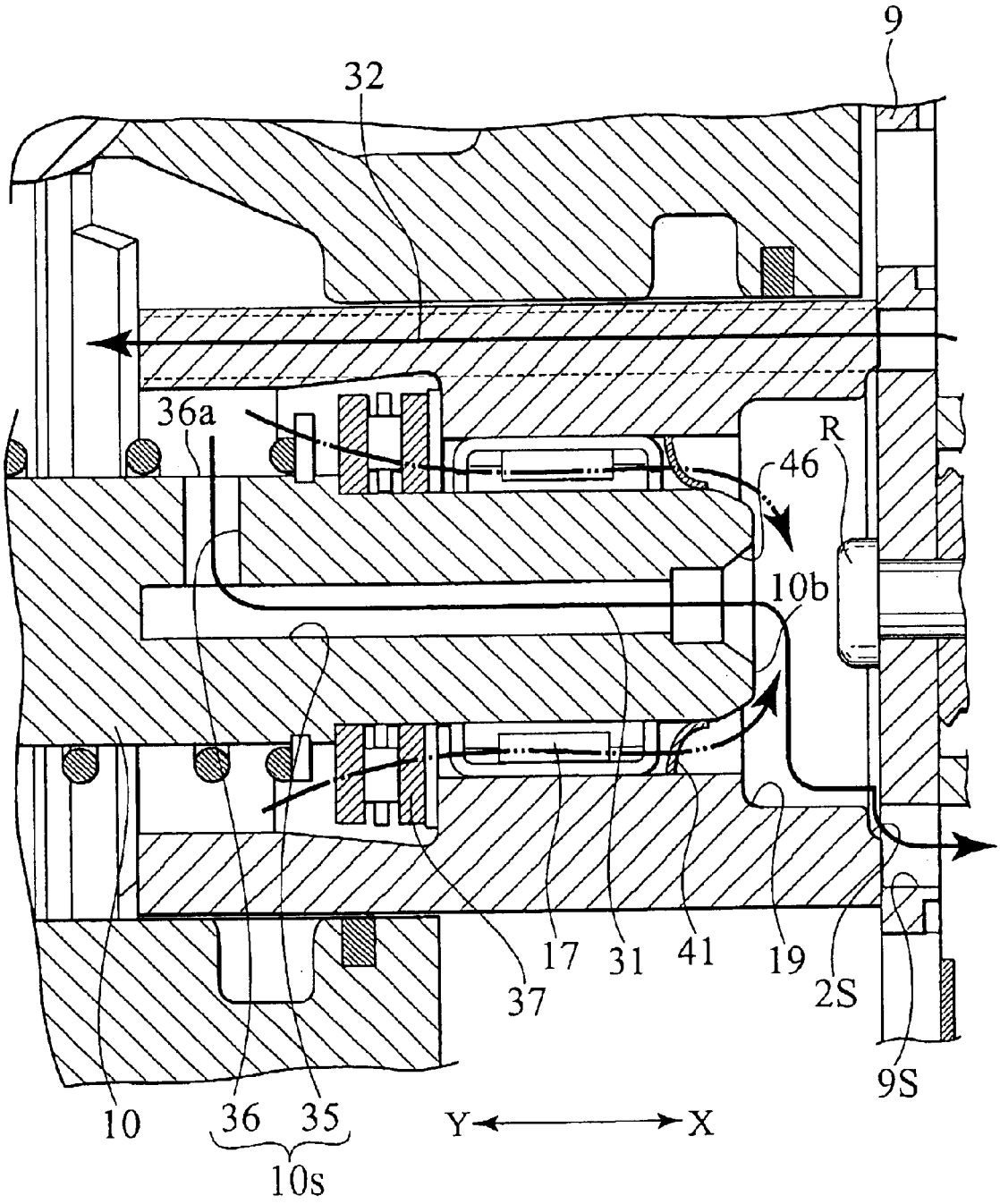
FIG. 12 is a cross sectional view of substantial parts of a compressor in the second embodiment according to the present invention.

A compressor according to the second embodiment of the present invention is shown in FIG. 12. It is noted that the compressor shown in FIG. 12 has the same parts as the compressor according to the first embodiment, and like parts are designed by like numbers and details thereof are omitted.

The compressor of the present embodiment differs from the compressor of the first embodiment in the provision of a seal member. A lip seal 41 as the seal member is attached to the drive shaft 10 to seal a gap between an inner peripheral surface of the shaft support bore 19 and an outer peripheral surface of the drive shaft 10.

According to the compressor of the present embodiment, the amount of oil flowing out from the crank chamber 5 can be further decreased by a seal action of the lip seal 41. Specifically, although it is possible that the refrigerant gas within the crank chamber 5, as shown by an imaginary line in FIG. 11, by-passes the gas extraction aperture 10*s* (35, 36) and passes through the bearings 17, 37 to gradually escape from the gap between the inner peripheral surface of the shaft support bore 19 and the outer peripheral surface of the drive shaft 10 toward the downstream side X of the gas extraction passage 31, the lip seal 41 prevents the refrigerant gas accompanying oil from by-passing the gas extraction aperture 10*s*. Consequently, is decreased the amount of oil flowing out from the crank chamber 5.

Here, since the lip seal 41 is attached to the drive shaft 10 at a surface thereof closer to the rear housing 6 than to the bearings 17, 37 (that is, at the downstream side X of the gas extraction passage 31), oil stored in the crank chamber 5 is supplied to these bearings 17, 37 by capillary action, and the like.

Hereinafter, preferred embodiments are further described, and if a compressor of each preferred embodiment has the same parts as the compressor according to the first embodiment and the second embodiment, like parts are designed by like numbers and details thereof are omitted.

(Third Embodiment)

Figure 13:
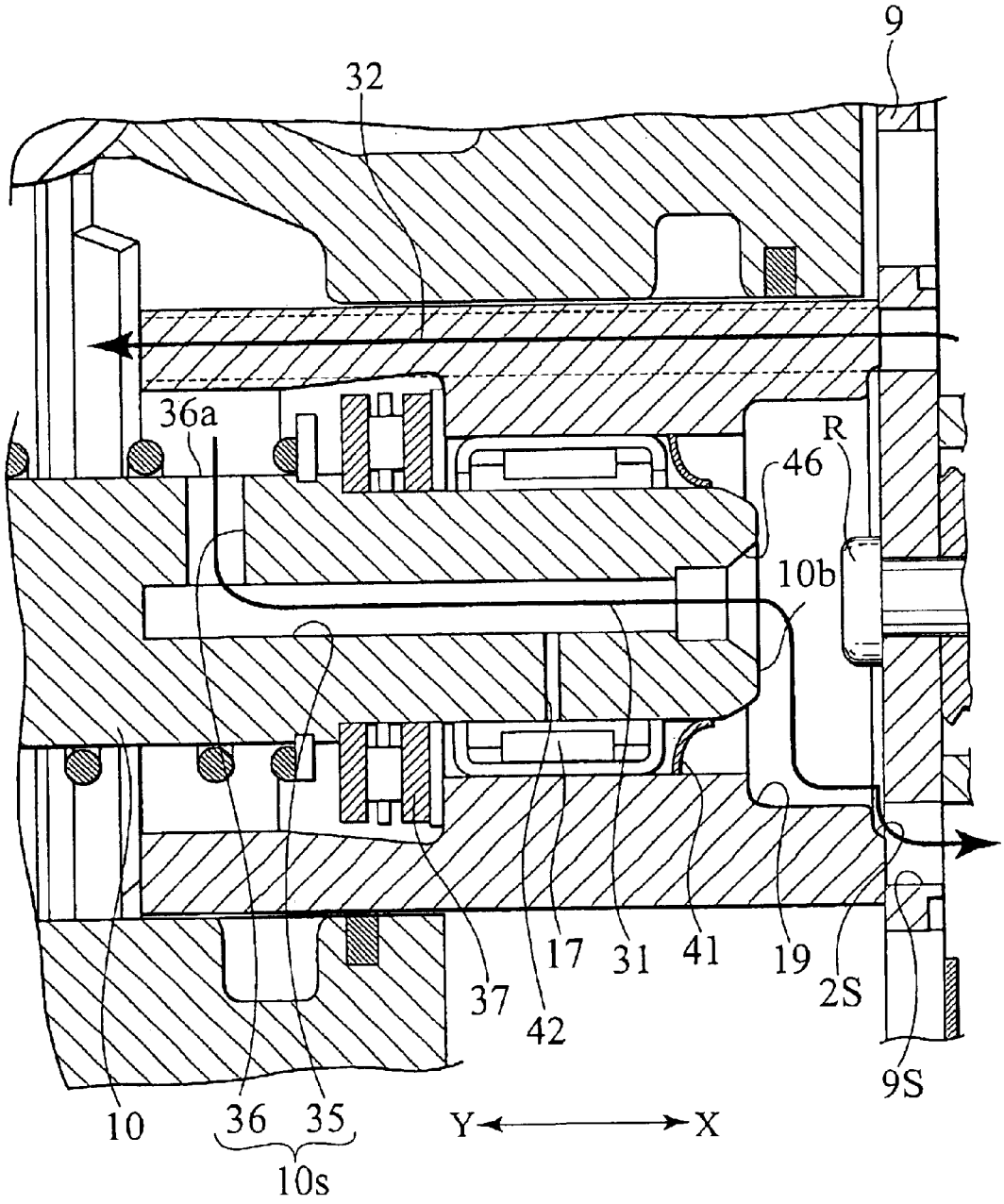
FIG. 13 is a cross sectional view of substantial parts of a compressor in the third embodiment according to the present invention.

A compressor according to the third embodiment of the present invention is shown in FIG. 13. The compressor of the present embodiment differs from the compressor of the second embodiment in the provision of an oil supply passage 42. One end of the oil supply passage 42 is connected to the axial passage 35 as the oil supply passage 42 communicates with the axial passage 35, and the other end thereof is directly open to the bearing 17.

Therefore, in the compressor of the present embodiment, the bearing 17 being one of the sliding component parts can be supplied with oil having flowed into the axial passage 35 to be adhered to an inner peripheral surface of the axial passage 35 due to a centrifugal force. As a result, an endurance of the bearing 17 improves in this provision.

Moreover, according to the present invention, since this oil supply passage 42 is directly open to the space around the bearing 17 closer to the crank chamber 5 than to the lip seal 41, oil discharged from the oil supply passage 42 exits in that space. It amounts to this, that is further decreased the amount of oil flowing out from the crank chamber 5 because oil having once flowed into the axial passage 35 is discharged into the space around the bearing 17 closer to the crank chamber 5.

(Forth Embodiment)

Figure 14:
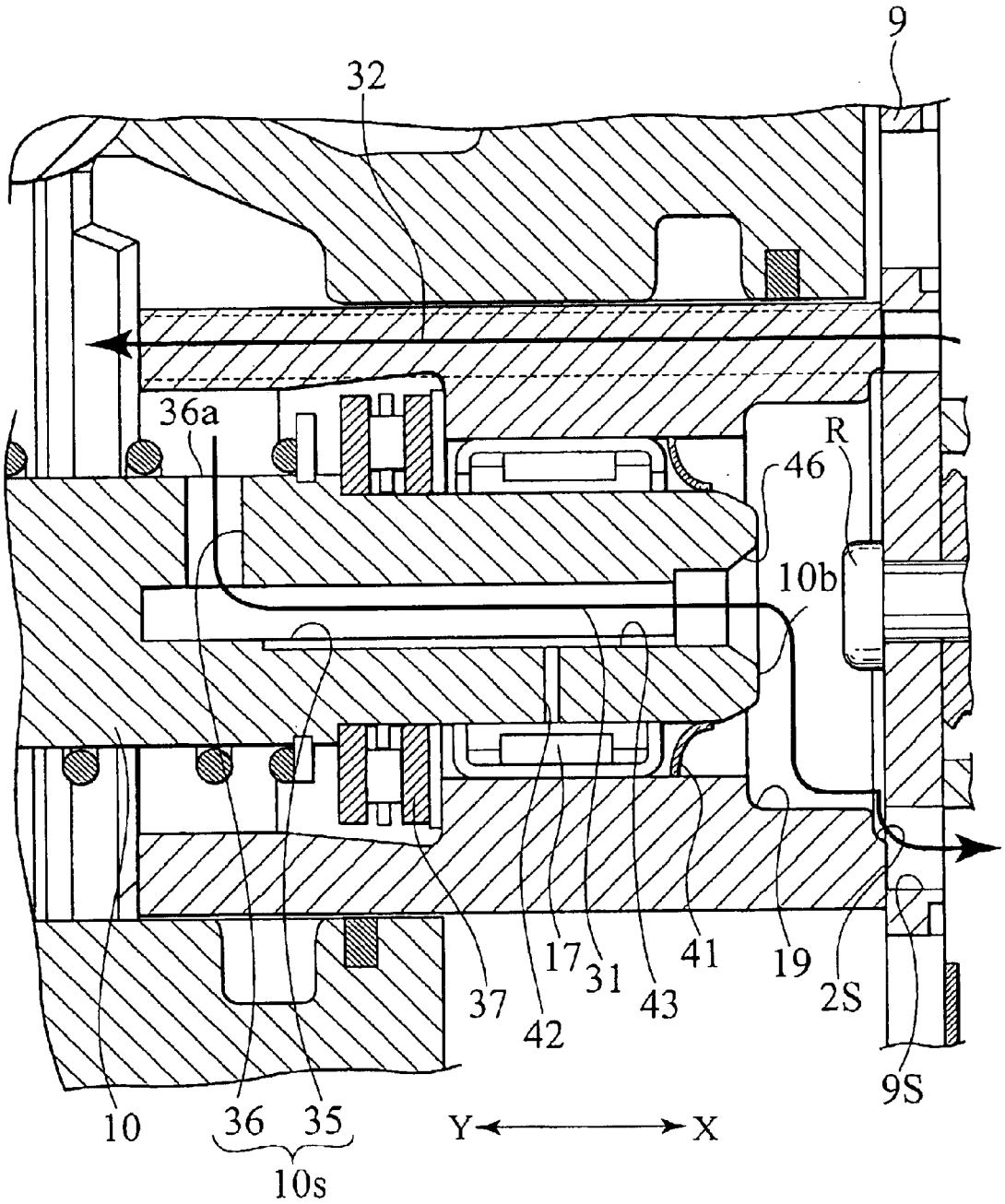
FIG. 14 is a cross sectional view of substantial parts of a compressor in the forth embodiment according to the present invention.

A compressor according to the forth embodiment of the present invention is shown in FIG. 14. The compressor of the present embodiment differs from the compressor of the third embodiment in the provision of a ditch 43 of the axial passage 35. The inner peripheral surface of the axial passage 35 is provided with the ditch 43 extending straight from the rear end portion of the drive shaft 10 toward the front end portion thereof.

According to the compressor of the present embodiment, since the inner peripheral surface of the axial passage 35 is provided with the ditch 43, is largely captured within the ditch 43 oil flowing onto the inner peripheral surface. Oil captured within the ditch 43 is hard to be carried toward the downstream side X of the gas extraction passage 31 (the suction chamber 7 side) because that oil is hard to be affected by a dynamic pressure of the refrigerant gas flowing within the axial passage 35. Consequently, the amount of oil flowing out from the gas extraction passage 31 is further decreased. Here, in the present embodiment, is formed to the ditch 43 an inlet portion of the oil supply passage 42, thereby the compressor of this embodiment has the advantage of an increase in the amount of oil flowing out from the oil supply passage 42 in comparison with that of the third embodiment.

(Fifth Embodiment)

Figure 15:
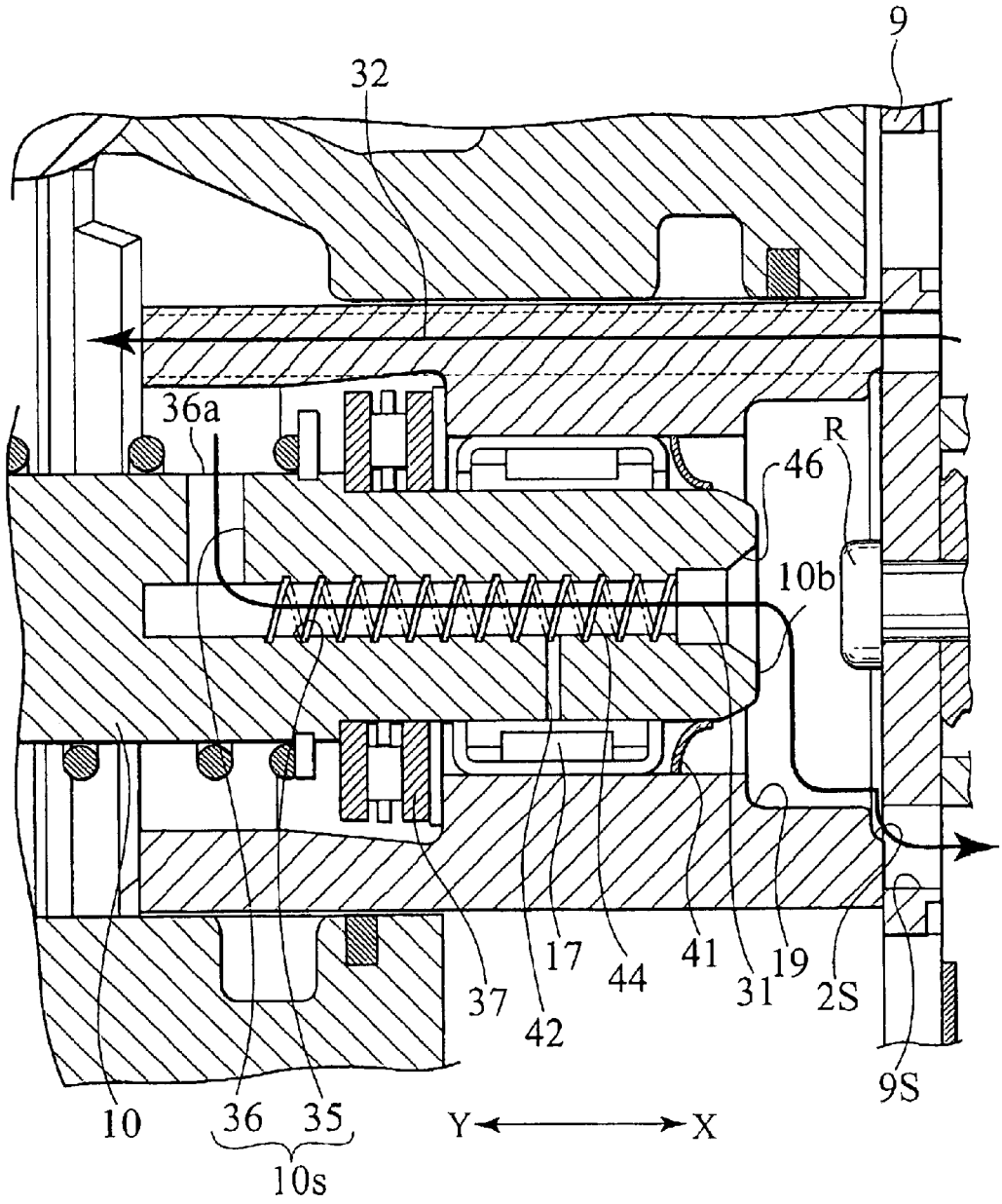
FIG. 15 is a cross sectional view of substantial parts of a compressor in the fifth embodiment according to the present invention.

A compressor according to the fifth embodiment of the present invention is shown in FIG. 15. The compressor of the present embodiment differs from the compressor of the forth embodiment in the configuration of the ditch 44. The ditch 44 is spirally formed on the inner peripheral surface of the axial passage 35. Here, in the present embodiment, is formed to the ditch 44 the inlet portion of the oil supply passage 42 like the ditch 43 in the forth embodiment.

According to the compressor of the present embodiment, in addition to the advantage of the forth embodiment, since the ditch 44 intersects the axial direction (the flow direction of the refrigerant gas), oil captured within the ditch 44 is further hard to be affected by the dynamic pressure of the refrigerant gas to be little carried toward the downstream side X. It amounts to this, that the ditch 44 acts like a resistant portion preventing oil from flowing toward the axial direction (the flow direction of the refrigerant gas).

Even in this ditch 44, it is expected to occur an action for pushing back oil to the radial passage 36 positioned at an upstream side Y of the gas extraction passage 31. Here, for example, the ditch 44 is formed as screw ditch by a method in tapping on the surface thereof from a rear end opening 46 of the drive shaft 10.

(Sixth Embodiment)

Figure 16:
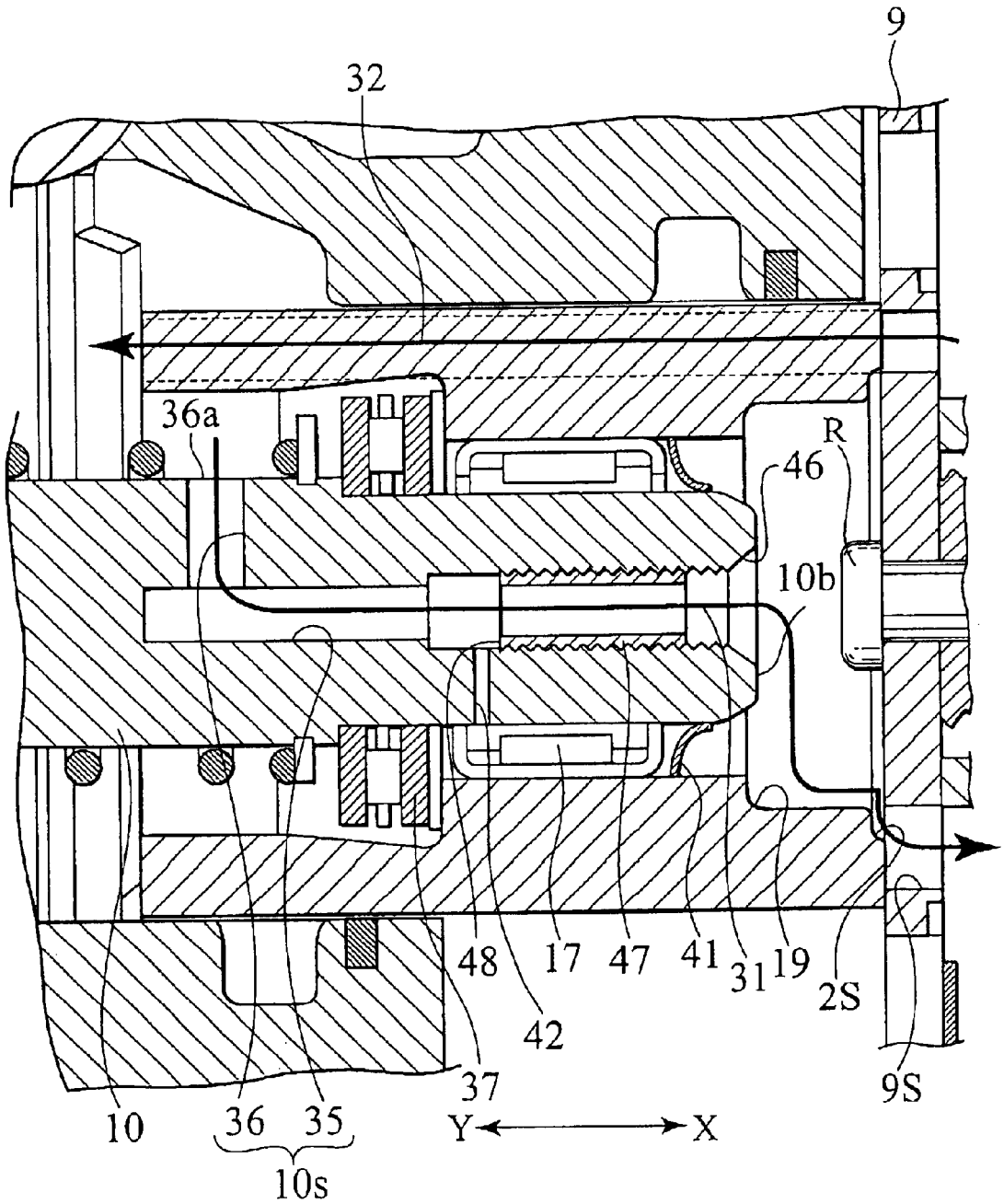
FIG. 16 is a cross sectional view of substantial parts of a compressor in the sixth embodiment according to the present invention.

A compressor according to the sixth embodiment of the present invention is shown in FIG. 16. The compressor of the present embodiment differs from the compressor of the fifth embodiment in the provision of a bump surface 48 as the resistant portion. A bushing 47 is inserted into the axial passage 35 from the rear end opening 46 of the drive shaft 10 and fitted into the axial passage 35. Thereby, a front end (the bump surface 48) of the bushing 47 is perpendicular to the axial direction (the flow direction of the refrigerant gas). Consequently, the bump surface 48 acts like a resistant portion preventing oil, being cable of flowing on the inner peripheral surface of the axial passage 35, from flowing toward the axial direction (the flow direction of the refrigerant gas). Therefore, the compressor of the present embodiment has an action effect like that of the compressor of the fifth embodiment.

According to the first to the sixth embodiments of present invention, since the drive shaft 10 is formed with the gas extraction passage 31, comprised of the axial passage 35 extending along the axis of the drive shaft 10, and the radial passage 36 perpendicularly connected to the axial passage 35 while forming the inlet portion of the gas extraction passage 31, directly exposed to the crank chamber 5, in the drive shaft 10 so as to radially extend, the amount of oil flowing out from the crank chamber 5 through the gas extraction passage 31 can be decreased in a simplified structure. Also, due to mist-like oil scattering from the inlet terminal end 36*a* of the radial passage 36 toward the crank chamber 5, oil can be automatically supplied to the sliding component parts within the crank chamber 5.

Figure 7:
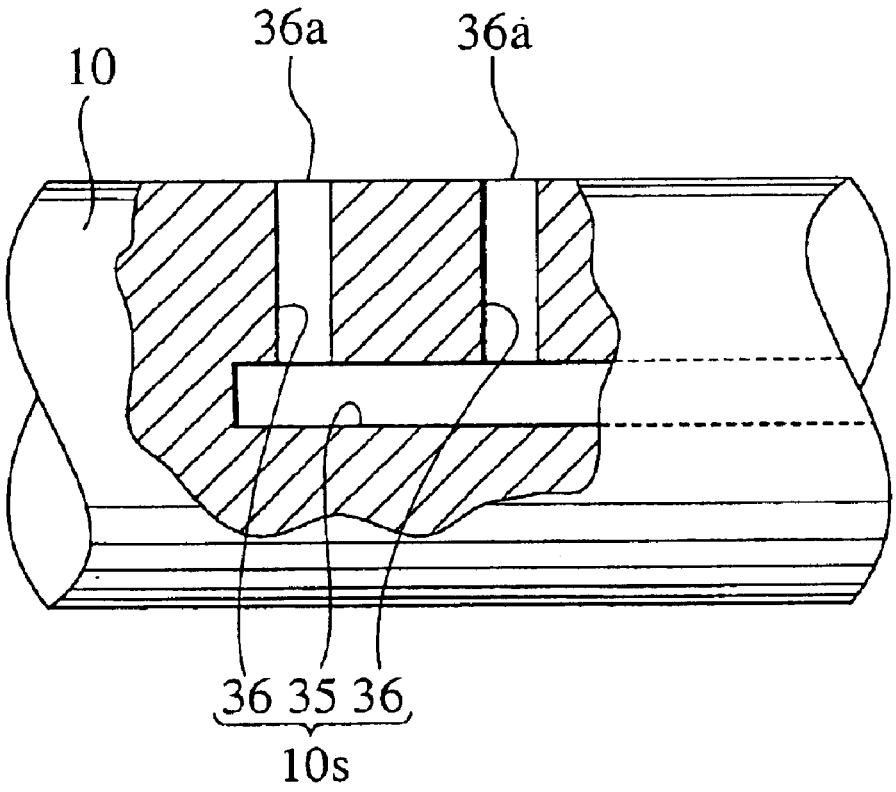
FIG. 7 is a view illustrating a modified form of a radial passage of the gas extraction passage of the compressor shown in FIG. 1.
Figure 8A:
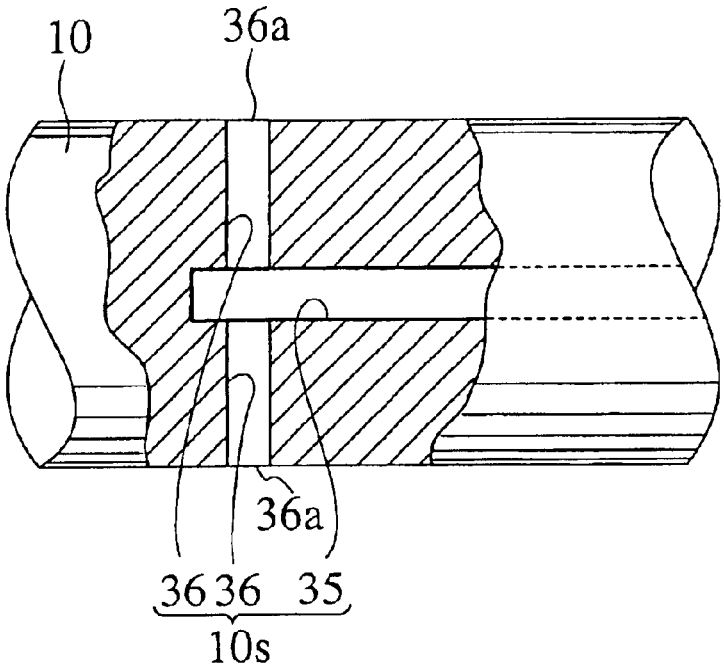
FIG. 8A is a view illustrating another modified form of the radial passage of the gas extraction passage of the compressor shown in FIG. 1.
Figure 8B:
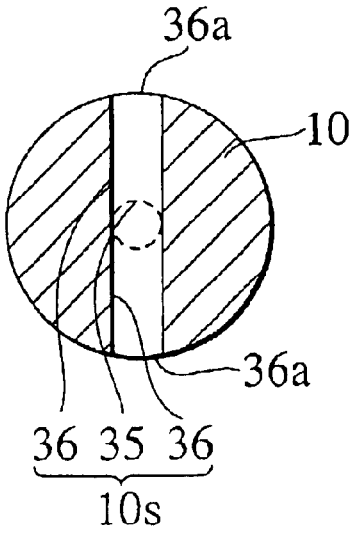
FIG. 8B is a cross sectional view illustrating one example of an inlet portion of the gas extraction passage of the compressor shown in FIG. 8A.
Figure 8C:
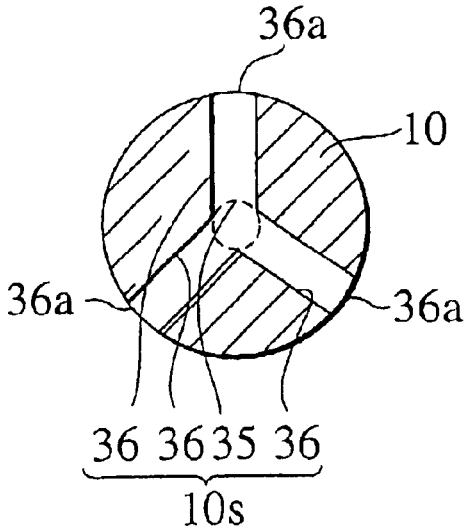
FIG. 8C is a cross sectional view illustrating another example of an inlet portion of the gas extraction passage of the compressor shown in FIG. 8A.
Figure 9:
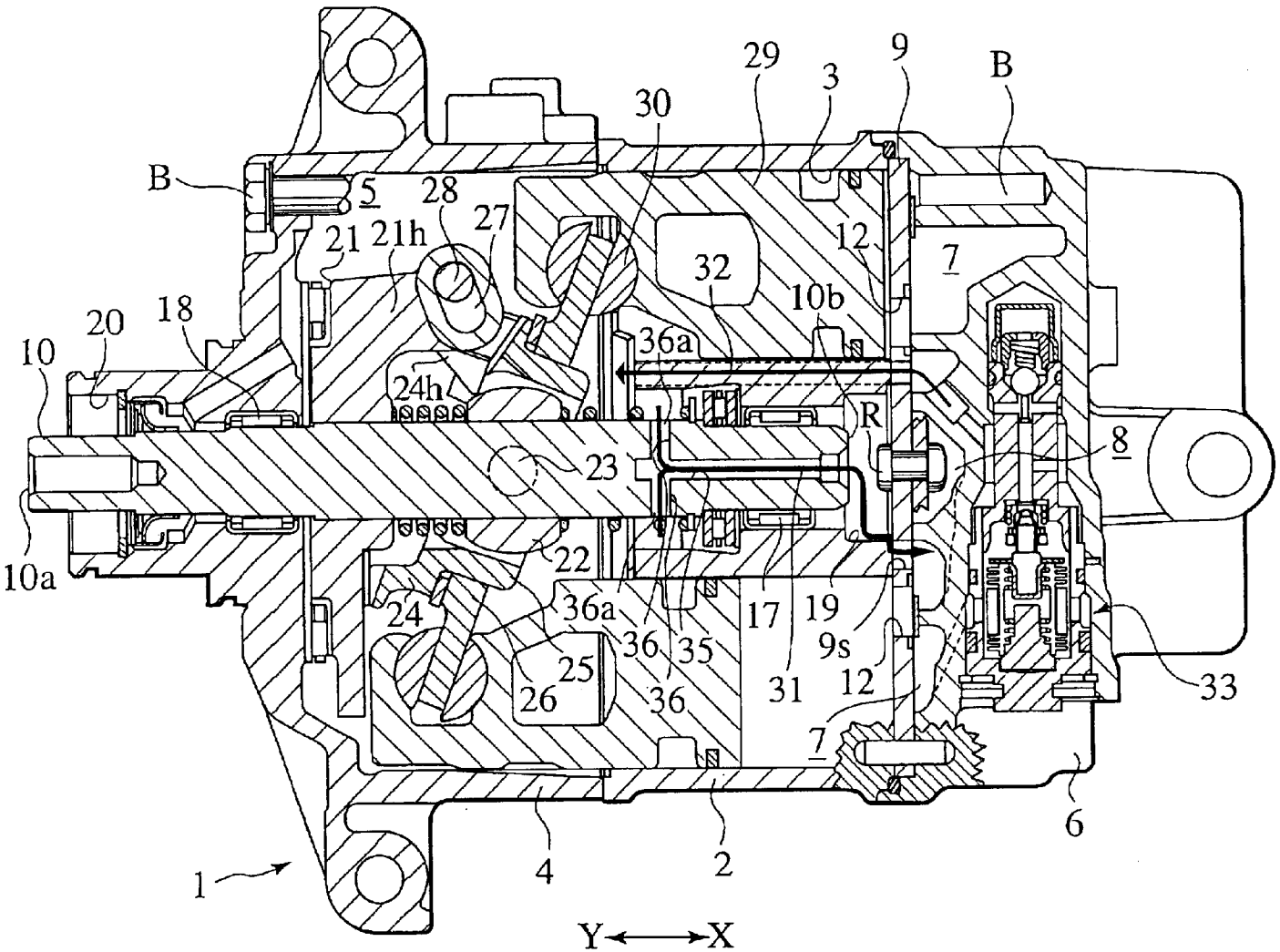
FIG. 9 is an overall view of a compressor having another modified radial passage of the gas extraction passage of the compressor shown in FIG. 1.

Moreover, the present invention includes a modification of the radial passage 36 shown in FIG. 7 to FIG. 11. Specifically, according to the present invention, a plurality of radial passages 36 may be provided to form associated inlet portions of the gas extraction passage 31. In particular, as shown in FIG. 7, a plurality of radial passages 36 may be formed in the drive shaft 10 at plural locations in parallel with respect to one another along the axial passage 35 of the drive shaft 10 and perpendicularly connected to the axial passage 35. Also, as shown in FIG. 8A, a plurality of radial passages 36 extending toward an outer periphery of the drive shaft 10 from the axial passage 35 of the drive shaft 10. In particular, as shown in FIG. 8B, radial passages 36 may be perpendicularly connected to the axial passage 35 and extend through the drive shaft 10, and as shown in FIG. 8C, a plurality (i.e., three pieces in FIG. 8C) of radial passages 36 may be perpendicularly connected to the axial passage 35 and radially extend from the center of the drive shaft 10 toward the outer periphery thereof. Thus, when formed with the plurality of radial passages 36, as shown in FIG. 9, the amount of refrigerant gas flowing into one radial passage 36 tends to decrease and, to that extent, oil is hard to be adversely affected by the gas stream passing through each radial passage 36, resulting in an advantage of centrifugal separating action being further effectively exhibited.

Figure 10:
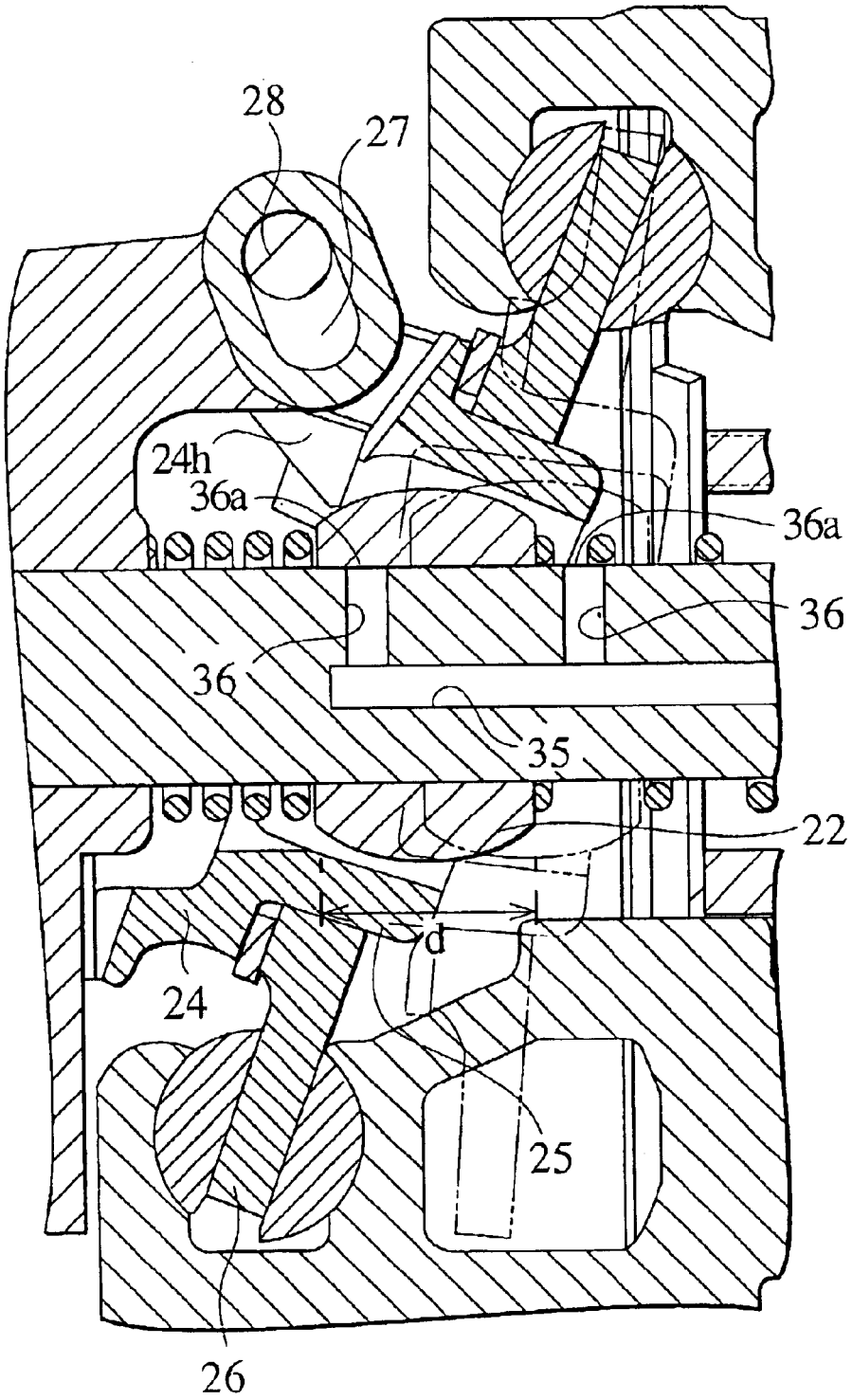
FIG. 10 is a cross sectional view of the modified radial passage shown in FIG. 9.

Further, with the embodiments described above, although the radial passage 36 has been shown as being formed in the area displaced from the moveable range of the sleeve 22, in a particular case where the radial passage 36 has no choice but to be formed in the moveable range of the sleeve 22, as shown in FIG. 10, a plurality of radial passages 36 may be formed in the drive shaft 10 at axially spaced positions displaced from one another by a distance greater than an axial length d of the sleeve 22, with at least one of the radial passages 36 being configured to directly open to the crank chamber 5.

Figure 11:
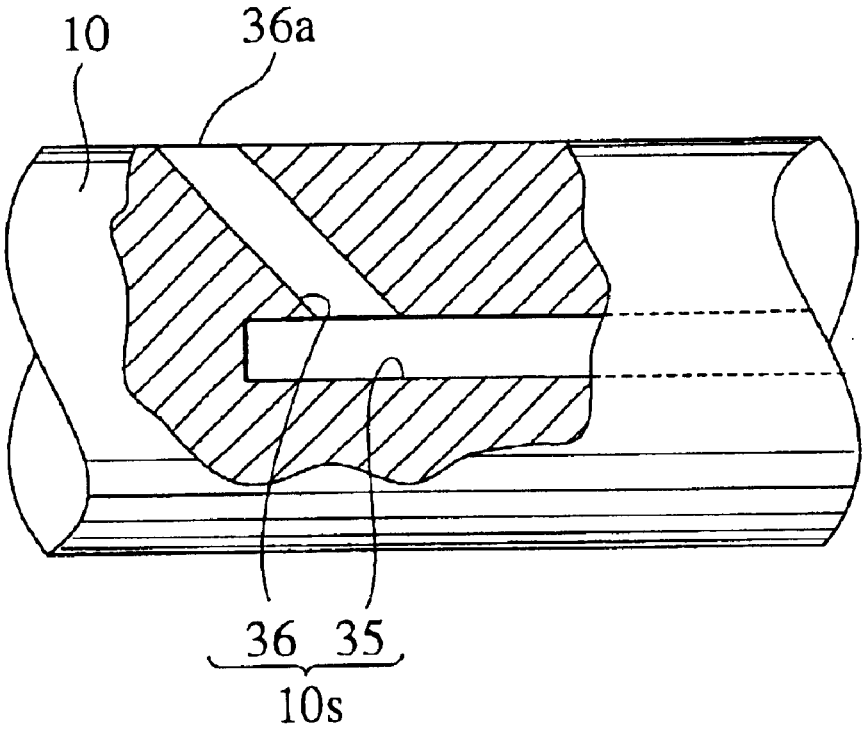
FIG. 11 is a cross sectional view of a modification of the radial passage of the gas extraction passage of the compressor shown in FIG. 1.

Furthermore, according to the present invention, the axial passage 35 may be formed in eccentric relation to the central axis of the drive shaft 10 provided that the radial passage 36 radially extends from the inlet terminal end 36*a* thereof toward the axial passage 35 so as to exhibit the centrifugal separating action. Moreover, as shown in FIG. 11, the radial passage 36 may be inclined with respect to the axial passage 35 and intersects the same. While the position at which the radial passage 36 is opened is limited to some extents, if it is structured such that, as shown in FIG. 11, if the inlet terminal end 36*a* is inclined so as to be oriented toward the sliding component parts (i.e., a sliding area between a shoe pocket and a shoe, and a sliding area between the shoe and the swash plate), oil scattering utilizing the centrifugal force occurs with a resultant capability of permitting oil to be more positively supplied to the sliding component parts.

Further, while the above described embodiments has been shown as including the swash type variable displacement compressor 1, the present invention may also be applied to variable volume compressors of other types such as a wobble type and, of course, may also be applied not only to the variable volume type but also to a fixed volume type compressor.

What is claimed is:

1. A compressor comprising:

a cylinder block having a cylinder bore for accommodating a piston, bearings for supporting an end portion of a drive shaft, and a shaft support bore disposed between the bearings and a rear end of the cylinder block;

a front housing attached to a front end of the cylinder block and formed with a crank chamber in which the piston is reciprocally moveable due to rotation of the drive shaft;

a rear housing attached to the rear end of the cylinder block via a valve plate and formed with a suction chamber and a discharge chamber therein; and a seal member attached to the drive shaft to seal a gap between the shaft support bore and the drive shaft, wherein a distal end portion of the drive shaft having a first gas extraction aperture is rotatably fitted in the shaft support bore adjacent to the valve plate having a second gas extraction aperture at the rear end of the cylinder block, in the first gas extraction aperture, one opening end thereof being directly open to the crank chamber and the other opening end thereof being open to the shaft support bore, and in the second gas extraction aperture, one opening end thereof being open to the shaft support bore and the other opening end thereof being open to the suction chamber.

2. The compressor according to claim 1, wherein there is a gas extraction recess at a rear distal end of the cylinder block and, in the gas extraction recess, one opening end thereof is open to the shaft support bore and the other opening end thereof is open to the second gas extraction aperture.

3. The compressor according to claim 1, wherein the seal member is attached to the drive shaft at a rear housing side relative to the bearings.

4. The compressor according to claim 3, wherein an oil supply passage is formed in the drive shaft, one opening end of the oil supply passage being open to the first gas extraction aperture and the other opening end thereof being open to the bearings.

5. The compressor according to claim 1, wherein the first gas extraction aperture includes an axial passage formed in the drive shaft along a central axis thereof and a radial passage connected to the axial passage and formed in the drive shaft along a radial direction, one opening end of the radial passage being directly open to the crank chamber.

6. The compressor according to claim 5, wherein a resistant portion is formed in the axis passage and prevents oil capable of flowing on an inner peripheral surface of the axis passage from flowing toward the axial direction.

7. The compressor according to claim 5, wherein a ditch is formed on an inner peripheral surface of the axis passage.

8. The compressor according to claim 7, wherein the ditch is spirally formed on the inner peripheral surface of the axial passage.

9. The compressor according to claim 5, wherein the radial passage extends through the drive shaft.

10. The compressor according to claim 5, wherein the radial passage includes a plurality of passage components that are formed in the drive shaft along the axial passage to extend in parallel with respect to one another.

11. The compressor according to claim 5, wherein the radial passage includes a plurality of passage components that radially extend from the axial passage toward an outer periphery of the drive shaft.

12. The compressor according to claim 5, wherein the radial passage is connected to the axial passage at an inclined angle with respect thereto.

13. A compressor comprising:

a cylinder block having a cylinder bore for accomodating a piston, bearings for supporting an end portion of a drive shaft, and a shaft support bore disposed between the bearings and a rear end of the cylinder block;

a front housing attached to a front end of the cylinder block and formed with a crank chamber in which the piston is reciprocally movable due to rotation of the drive shaft; and a rear housing attached to the rear end of the cylinder block via a valve plate and formed with a suction chamber and a discharge chamber therein, wherein a distal end portion of the drive shaft having a first gas extraction aperture is rotatably fitted in the shaft support bore adjacent tot he valve plate having a second gas extraction aperture at the rear end of the cylinder block, in the first extraction aperture, one opening end thereof being directly open to the crank chamber and the other opening end thereof being open to the shaft support bore, and in the second gas extraction aperture, one opening end thereof being open to the shaft support bore and the other opening end thereof being open to the suction chamber, wherein the first gas extraction aperture includes an axial passage formed in the drive shaft along a central axis thereof and a radial passage connected to the axial passage and formed in the drive shaft along a radial direction, one opening end of the radial passage being directly open to the crank chamber, wherein a resistant portion is formed in the axis passage and prevents oil capable of flowing on an inner peripheral surface of the axis passage from flowing toward the axial direction.

* * * * *